137-13 SR
6/7/77 OR 4,027,688

United States Patent [19]
Gruber et al.
[11] 4,027,688
[45] June 7, 1977

[54] TRANSPORTATION OF FOSSIL FUEL MATERIALS

[75] Inventors: Kurt Gruber, Monchengladbach; Willi Keim, Aachen-Walheim; Klaus Hentschel, Aachen, all of Germany

[73] Assignee: Mannesmannrohren-Werke AG, Dusseldorf, Germany

[22] Filed: Jan. 22, 1975

[21] Appl. No.: 543,242

[30] Foreign Application Priority Data

Jan. 30, 1974 Germany ..... 2404326

[52] U.S. Cl. ..... 137/13; 302/66; 62/55

[51] Int. Cl.² ..... F17D 1/16

[58] Field of Search ..... 137/1, 3; 302/66; 62/55; 166/DIG. 1; 208/19, 18, 370; 44/51, 80

[56] References Cited

UNITED STATES PATENTS

| | | | |
|---|---|---|---|
| 3,389,714 | 6/1968 | Hughes | 137/13 |
| 3,670,752 | 6/1972 | Marsden | 137/13 |
| 3,730,201 | 5/1973 | Lefever | 62/55 X |
| 3,926,203 | 12/1975 | Marsden | 137/13 |

*Primary Examiner*—Alan Cohan
*Attorney, Agent, or Firm*—Brisebois & Kruger

[57] ABSTRACT

Fossil fuel such as crude oil or coal is transported through a pipe by converting some of the constituents of the fossil fuel, such as natural gas, into methanol. The methanol is then used to form an emulsion with the fossil fuel. The emulsion is transported by pipeline.

10 Claims, 5 Drawing Figures

TRANSPORTATION OF FOSSIL FUEL MATERIALS

Figure 1:
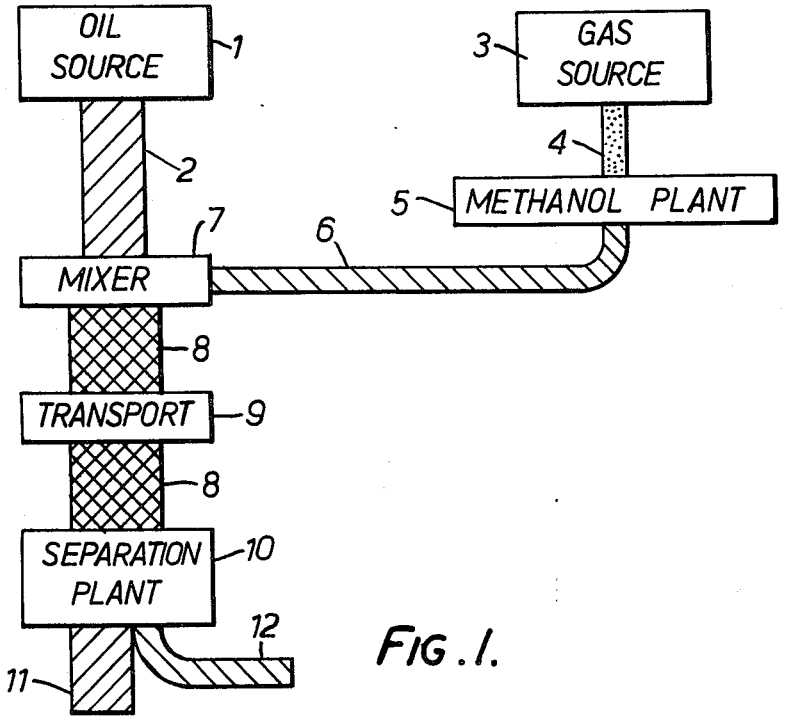

The invention relates to the long-distance transport of fossil fuel materials by the use of fluid transport techniques, such as those suggested for the transport of coal in a water slurry through a pipe, and the transport of LPG (liquefied petroleum gas consisting of liquefied propane and butane) occurring in a gas/oil source, with the crude oil, over great distances, if the LPG cannot be conveyed separately and directly to the consumer. LPG is liquid at normal temperature and at a pressure of 2–3 atmospheres absolute and can be dissolved in crude oil. This ensures that with the transport pressures customary in a pipe line, i.e. 25–55 atmospheres absolute, the LPG will be maintained in the liquid phase.

Mineral oil ($C_5$–$C_X$ hydrocarbons) and natural gas ($C_1$–$C_4$ hydrocarbons) frequently occur together. The mixture reaching the surface from the borehole thus consists of gas and crude oil. The individual constituents are then separated from one another to form:

a. dry gas (methane and ethane)
b. LPG (liquefied petroleum gas, consisting of propane and butane) and
c. natural gasoline (casing head gasoline).

The dry gas is frequently flared off, owing to lack of transport facilities, or pumped back into the borehole. In oilfields with ample reserves of crude oil and natural gas, separate pipelines are constructed, but the laying of pipelines for the transport of the dry gas is not attempted because of the high cost. The natural gasoline is either consumed direct or transported in the crude oil.

The high cost of a gas pipeline system for dry gas has resulted, inter alia, in the proposal that natural gas should be transported in pipes in its liquefied state, as the diameter of the pipes can then be made much smaller than in the case of a piping system for gas as such. The need to maintain the temperature at or below −160°C results however in further problems and expense, involving inter alia the use of low temperature steels for the pipe and costly insulation. The transport of liquefied gas in special ships is equally complicated and costly, necessitating tanks of a temperature-resisting material, with the appropriate insulation. Finally, the liquefaction of the dry gas requires a great amount of energy.

Generally, therefore, whenever primary fuels occur in different forms, particularly in regions close to one another, a number of separate transport systems are required. The costs involved often exceed the profits obtainable when the deposits are comparatively small or not easily accessible, so that many gas deposits cannot be utilized to the full, if at all.

An object of the invention is to provide a process and apparatus enabling fossil fuel materials to be transported economically over long distances.

In one aspect, the invention provides a process for the long distance transport of fossil fuel material, in which a part of the fossil fuel material to be transported is converted into methanol before being transported, and is utilized as a transport medium in the fluid transport of the remainder of the material.

If the fossil fuel material is coal, the part of the coal not converted into methanol is converted into liquid hydrocarbons which are mixed with the methanol and then transported over the long distance involved. There is then the advantage that what is transported can consist wholly of liquid, which does not subject the piping to the wear caused by the transport of coal in water.

A preferred form of the invention relates to the transport over long distances, together with the crude oil itself, of products obtained from crude oil and/or natural gas, and is characterised by the fact that at least some of the oil and/or natural gas is converted into methanol, which is mixed with the remaining oil, and the oil-methanol mixture is separated into its components after being transported. An emulsion stabiliser may be added when the methanol is being mixed with the crude oil.

If crude oil and natural gas occur in identical or adjacent deposits, substantially all of the lower hydrocarbon constituents of the natural gas, i.e. methane and ethane, are converted into methanol and mixed with the oil.

In this way, the gaseous constituents of a deposit or the natural gas from a gas source adjacent to a crude oil source are transported with the oil, by converting them into the liquid consisting of methanol, a single channel, e.g. a single pipeline, being used for the conveyance of the fossil fuel material. Fields close together and only having very limited reserves can thus be economically exploited.

A further advantage results from the fact that the addition of methanol reduces the viscosity of viscous tar oils, such as those obtained from deposits in Venezuela, which are then rendered capable of being pumped and thus transported. The hydrocarbons extracted from oil sands, oil shale, tar sands or the like can be similarly transported together with methanol.

The invention further provides a transportation system for fossil fuel material comprising a converter for converting part of the material into methanol, means for mixing the methanol with the remainder of the material, and means for transporting the resulting mixture.

The conversion of fossil fuel materials, such as coal, crude oil and natural gas, into methanol presents no technical difficulties and is already known in the industry. The conversion is performed via the production in an intermediate stage of synthesis gas, which is a mixture of carbon monoxide and hydrogen. It can be produced by a number of well known technical processes from a great variety of hydrocarbons, such as methane, ethane, LPG, naphtha and fuel oil. The presently preferred processes are:

1. Steam Reforming $$, CH_x + H_2O\ CO + (1 + 2^X)H_2$$

2. Partial Oxidation $$, CH_x + \tfrac{1}{2}O_2 \quad CO + {}^X2\ H_2$$

The conversion of synthesis gas into methanol is also well known in the art and is mainly represented by two processes, i.e. the low-pressure process and the high-pressure process.

Figure 2:
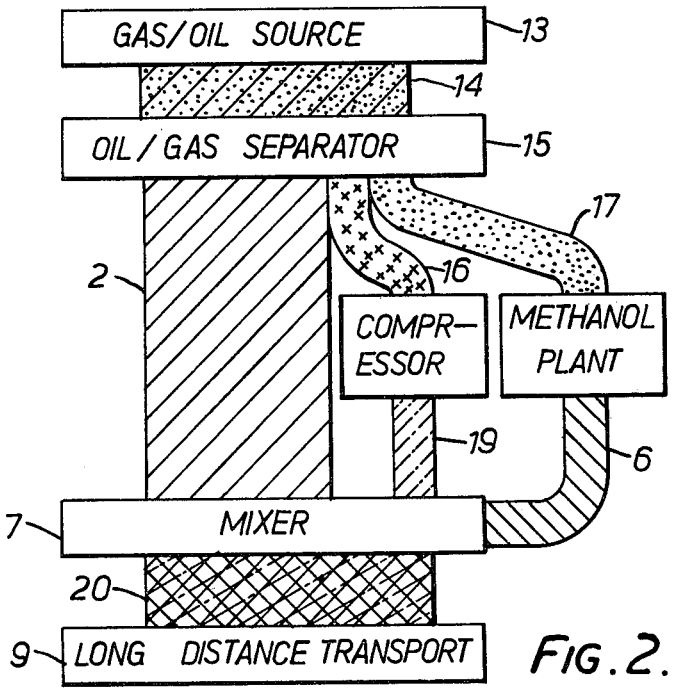
Figure 3:
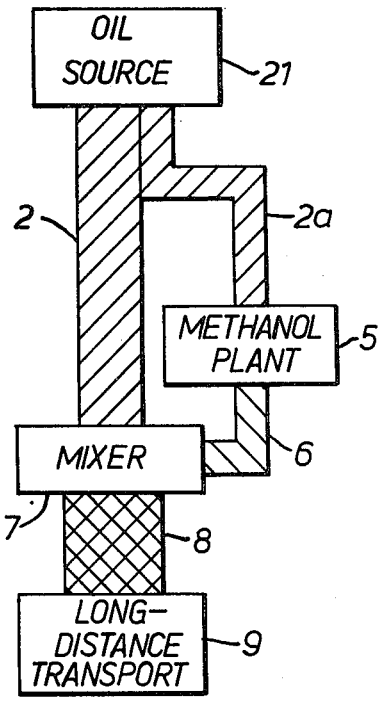
Figure 4:
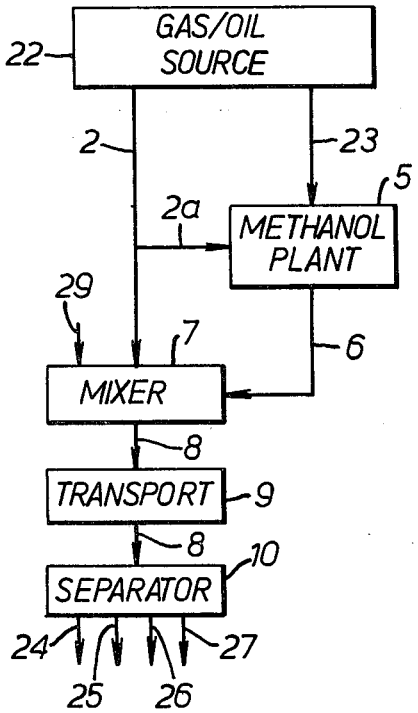
Figure 5:
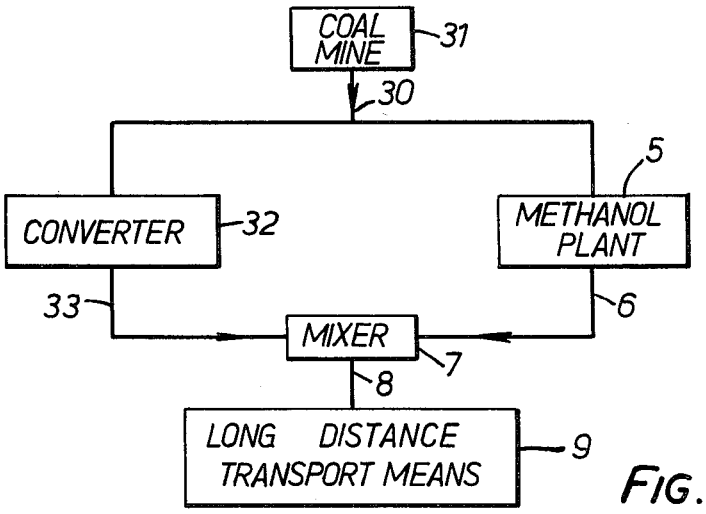

The invention will be more readily understood by way of example from the following description of processes and apparatus for the transport of fossil fuel materials, reference being made to the accompanying drawings, in which:

FIG. 1 schematically illustrates the transportation system, when crude oil and natural gas occur in separate but adjacent deposits, FIG. 2 illustrates a system for use when the crude oil and natural gas occur in one and the same source, FIG. 3 shows the system for a source of crude oil alone, FIG. 4 illustrates the transport system, in which the gaseous constituents and part of the crude oil of crude oil source are converted into methanol, and FIG. 5 illustrates a liquid phase transport system for coal.

FIG. 1 shows a crude oil source 1 and a separate, but adjacent source 3 of natural gas. The natural gas 4 of the natural gas source 3 is fed to a methanol plant 5 in which it is converted into methanol 6. The crude oil 2 of the oil source 1 and the methanol 6 are conveyed to a mixer 7 in which a methanol-oil emulsion 8 forms. The emulsion 8 is then supplied to a transport means 9, such as a pipeline, from which it enters a separating plant 10 at the delivery station, to be separated into the components 11 and 12 of the mixture.

The ratio of crude oil to methanol in the mixture can be varied. If a particular stable emulsion is required, the ratio is chosen according to the nature of the crude oil in the deposit. Tests have shown, for example, that a mixture of 90% Kuwait crude oil and 10% methanol provide a sufficiently stable emulsion even without the use of an emulsion stabiliser. The methanol itself need not be pure but can be used in the form of crude methanol (methyl fuel).

In FIGS. 2, a crude oil-gas source 13, delivers oil and gas 14 to an oil-gas separating system 15, which separates the mixture into crude oil 2, LPG 16, and dry gas 17. The LPG 16 is liquefied in known manner in a compressor 18; the dry gas 17 is converted in plant 5 into methanol 6, and the liquid 19 from compressor 18, the methanol 6, and the liquid 19 from compressor 18, the methanol 6 and the crude oil 2 are mixed in mixer 7 to produce a methanol emulsion 2, which is fed to the long-distance transport means 9. The further steps in the process are not shown in FIGS. 2 and 3, being similar to those of FIG. 1.

FIG. 3 shows a source 21 of crude oil alone, as derived for example from an Arctic oil deposit. In those regions particular difficult environmental conditions have to be faced in the transport of the product over long distances. By the addition of methanol the viscosity and the setting point of the crude oil can be favourably influenced, so that the system can be operated at a lower pumping speed or lower transport temperatures. For this purpose a part 2*a* of the crude oil 2 is converted into methanol 6 in the methanol plant 5 and conveyed to the mixer 7 together with the remaining crude oil. The methanol crude oil emulsion 8 thus produced is then conveyed to the long-distance transport means 9.

FIG. 4 shows a further variant in which both the gaseous constituents 23 of a crude oil-gas source 22 and a part 2*a* of the crude oil 2 is converted into methanol 6 in the methanol plant 5 and conveyed to the mixer 7. In this case an emulsion stabiliser 29 is added to the said mixer 7. A suitable stabiliser, which can be used in any of the described systems, is an ester of sorbitol, as sold under the name "SPAN 65", or a polymerised carboxylicid acid, as sold under the name "TAMOL 731", or a petroleum sulphonate.

FIG. 5 represents the transport system for the movement of coal. A part of the coal 30 from a coal mine 31 is fed to the plant 5 and converted into methanol 6. The remainder of the coal 30 is directed to a converter 32 in which it is converted into liquid hydrocarbons 33. The mixer 7 receives the liquid outputs of both the plant 5 and the converter 32 and delivers an emulsion to the long distance transport means 9 as before.

In FIG. 4, the arrows 24, 25, 26 and 27 from the separating plant 10 at the delivery station, are intended to indicate that it is not necessary for the emulsion to be re-separated into methanol and crude oil in the separating plant 10 and that the mixture can be subdivided into other components, in which connection it must be borne in mind that methanol, when combined with oil, provides a fuel directly usable for motor vehicles and having excellent anti-knock properties.

The methanol derived from the separator 10 may be reconverted to natural gas, for use as a fuel. It may also be used without reconversion as a feed stock for further chemical processes, or as a fuel in its own right.

We claim:

1. A process for the long-distance transport of fossil fuel material, in which a part of the fossil fuel material to be transported is converted into methanol before being transported, and is utilised as a transport medium in the fluid transport of the remainder of the material.

2. A process according to claim 1, in which the material is coal, and the part of the coal not converted into methanol is converted into liquid hydrocarbons which are mixed with the methanol prior to transport.

3. A process as claimed in claim 1 in which the fossil fuel material is fossil oil and natural gas and in which at least the natural gas is converted into methanol, which is mixed with the oil, and the oil-methanol mixture is separated into its components after being transported.

4. A process for the long-distance transport of crude fossil oil and natural gas comprising the steps of a. converting at least some constituents of said natural gas into methanol;

b. forming an emulsion of said crude oil with said methanol; and c. transporting said emulsion.

5. A process according to claim 4, in which only the lower hydrocarbon constituents of said natural gas are converted into methanol, and the higher hyrocarbon constituents of said natural gas are liquified and mixed with said emulsion prior to transportation.

6. A process according to claim 4, in which some crude oil is also converted to methanol, the methanol converted from both said natural gas and said crude oil being mixed with crude oil to form said emulsion.

7. A process according to claim 4, in which after transportation said emulsion is separated into crude oil and methanol.

8. A process according to claim 4, in which an emulsion stabiliser is added during the forming of the emulsion.

9. A process according to claim 4, in which said emulsion is transported by pumping through a pipe line.

10. A process for the long-distance transport of crude oil comprising the steps of a. converting a part of said crude oil into methanol;

b. forming an emulsion of uncovered crude oil with said methanol; and c. transporting said emulsion.

* * * * *

Notice of Adverse Decision in Interference

In Interference No. 99,856, involving Patent No. 4,027,688, K. Gruber, W. Keim and K. Hentschel, TRANSPORTATION OF FOSSIL FUEL MATERIALS, final judgment adverse to the patentees was rendered Mar. 17, 1980, as to claims 1, 2 and 3.

[*Official Gazette September 30, 1980.*]